US007761999B2

(12) United States Patent
Macove

(10) Patent No.: US 7,761,999 B2
(45) Date of Patent: Jul. 27, 2010

(54) RAZOR HAVING SEPARATE BLADE GROUPS FOR SHAVING AND TRIMMING/SCULPTING

(76) Inventor: James A. Macove, 445 Ashbury St., No. 4, San Francisco, CA (US) 94117

( * ) Notice: Subject to any disclaimer, the term of this patent is extended or adjusted under 35 U.S.C. 154(b) by 0 days.

(21) Appl. No.: 12/323,947

(22) Filed: Nov. 26, 2008

(65) Prior Publication Data

US 2009/0071011 A1 Mar. 19, 2009

Related U.S. Application Data

(63) Continuation of application No. 10/750,244, filed on Dec. 31, 2003.

(60) Provisional application No. 60/490,813, filed on Jul. 29, 2003.

(51) Int. Cl.
*B26B 19/00* (2006.01)
*B26B 21/00* (2006.01)
*B21D 39/00* (2006.01)

(52) U.S. Cl. ..... 30/34.1; 30/50; 29/428

(58) Field of Classification Search ..... 30/34.1, 30/47, 50; D28/46; 29/428
See application file for complete search history.

(56) References Cited

U.S. PATENT DOCUMENTS

| | | | | |
|---|---|---|---|---|
| 840,244 | A | 1/1907 | Odell | |
| 1,272,816 | A | 7/1918 | Leslie | |
| 1,633,139 | A | 6/1927 | Staats-Oels | |
| 1,920,711 | A | 8/1933 | Pelizzola | |
| 2,151,265 | A | 3/1939 | Clausen | |
| 2,817,146 | A | 12/1957 | Roberts | |
| 3,488,764 | A | 1/1970 | Welsh | |
| 3,785,051 | A * | 1/1974 | Dawidowicz et al. | 30/40.2 |
| 3,934,338 | A * | 1/1976 | Braginetz | 30/47 |
| 4,285,124 | A | 8/1981 | Diakonov | |
| 4,461,078 | A * | 7/1984 | Carreker | 30/47 |
| 4,501,066 | A | 2/1985 | Sceberras | |
| 4,534,110 | A | 8/1985 | Glass | |
| 4,663,843 | A | 5/1987 | Savage | |
| 4,854,042 | A * | 8/1989 | Byrne | 30/34.1 |
| 4,901,437 | A | 2/1990 | Iten | |
| 4,980,974 | A | 1/1991 | Radcliffe | |
| 4,989,328 | A | 2/1991 | Sokoloff | |
| 4,993,153 | A * | 2/1991 | Henry | 30/50 |
| 5,036,587 | A * | 8/1991 | Trotta et al. | 30/41 |
| 5,133,131 | A | 7/1992 | Hoffman | |
| 5,199,173 | A * | 4/1993 | Hegemann et al. | 30/49 |

(Continued)

FOREIGN PATENT DOCUMENTS

| | | |
|---|---|---|
| FR | 2632886 | 12/1989 |

(Continued)

*Primary Examiner*—Jason Daniel Prone
(74) *Attorney, Agent, or Firm*—Nutter McClennen & Fish LLP

(57) ABSTRACT

A razor system is provided for shaving facial and body hair, the razor system having a handle and a razor cartridge. The razor cartridge has a primary group of blades and a second group of blades, such that the primary group of blades makes a first common plane and the second group of blades makes a second working plane. The first common plane and the second working plane are directionally-opposed. The present invention further relates to a method of shaving with the razor system.

7 Claims, 5 Drawing Sheets

U.S. PATENT DOCUMENTS

| | | | | |
|---|---|---|---|---|
| D343,922 | S * | 2/1994 | Ahlgren | D28/46 |
| 5,307,564 | A | 5/1994 | Schoenberg | |
| 5,343,622 | A | 9/1994 | Andrews | |
| 5,542,178 | A | 8/1996 | Harkleroad | |
| 5,575,068 | A | 11/1996 | Pedersen | |
| 5,778,535 | A | 7/1998 | Ledesma | |
| 5,784,790 | A | 7/1998 | Carson, III et al. | |
| D423,143 | S * | 4/2000 | Cowell | D28/46 |
| 6,052,905 | A | 4/2000 | Branchinelli et al. | |
| 6,161,288 | A | 12/2000 | Andrews | |
| 6,276,061 | B1 | 8/2001 | Rozenkranc | |
| 6,418,623 | B1 * | 7/2002 | Marcarelli | 30/50 |
| 6,499,218 | B2 | 12/2002 | Rocha | |
| 6,550,148 | B2 * | 4/2003 | Cecil | 30/50 |
| 6,560,876 | B2 * | 5/2003 | Carr | 30/50 |
| 6,928,738 | B2 * | 8/2005 | Segrea | 30/34.1 |
| 7,086,160 | B2 * | 8/2006 | Coffin et al. | 30/50 |
| 7,322,109 | B2 * | 1/2008 | Newkirk et al. | 30/50 |
| 7,617,607 | B2 | 11/2009 | Pennell et al. | |
| 2002/0050065 | A1 * | 5/2002 | Kludjian et al. | 30/50 |
| 2003/0182802 | A1 | 10/2003 | Vega et al. | |
| 2004/0055156 | A1 | 3/2004 | Brown, Jr. | |
| 2005/0022386 | A1 * | 2/2005 | Macove | 30/50 |
| 2005/0198825 | A1 | 9/2005 | Apprille | |
| 2005/0198828 | A1 | 9/2005 | Pennell et al. | |
| 2005/0198829 | A1 | 9/2005 | Gray et al. | |
| 2005/0198830 | A1 | 9/2005 | Walker et al. | |
| 2005/0198837 | A1 | 9/2005 | Rawle | |
| 2005/0198839 | A1 | 9/2005 | Walker | |
| 2005/0198840 | A1 | 9/2005 | Worrick et al. | |
| 2005/0198841 | A1 | 9/2005 | Worrick | |
| 2005/0198842 | A1 | 9/2005 | Walker et al. | |
| 2006/0196054 | A1 | 9/2006 | Luxton | |
| 2007/0214647 | A1 * | 9/2007 | Psimadas et al. | 30/50 |
| 2007/0283567 | A1 * | 12/2007 | Magli | 30/50 |
| 2008/0172878 | A1 * | 7/2008 | Luxton | 30/34.1 |
| 2009/0255124 | A1 * | 10/2009 | Hasbani | 30/50 |

FOREIGN PATENT DOCUMENTS

| | | |
|---|---|---|
| GB | 2406537 | 4/2005 |
| JP | 52015761 | 2/1977 |
| WO | WO 94/26476 | 11/1994 |

* cited by examiner

RAZOR HAVING SEPARATE BLADE GROUPS FOR SHAVING AND TRIMMING/SCULPTING

RELATED APPLICATIONS

This application is a continuation of U.S. patent application Ser. No. 10/750,244, filed Dec. 31, 2003, which claims priority to U.S. Provisional Application Ser. No. 60/490,813, filed on Jul. 29, 2003 and entitled "Razor Having Separate Blade Groups for Shaving and Trimming/Sculpting", both applications of which are incorporated by reference herein.

BACKGROUND

1. Field of the Invention

The present invention relates in general to hand-held razor structures, cartridges and systems for shaving, and in particular to hand-held versatile razor structures, cartridges and systems for shaving. The present invention comprises one or more razor blade strips, wherein a single razor head comprises a primary group of blades on a first common plane on a front face of a shaver head, wherein the primary group of blades is for shaving broad, relatively flat areas of hair, and a secondary blade group on a second common plane located on a top or top-back edge of the shaver head, wherein the second common plane is separate and distinct from the first common plane and the secondary blade group is for precise shaving in confined, contoured, hard-to-reach areas, especially around the nostrils, in crevices such as chin clefts, and around the edges of sideburns, mustaches and beards.

2. Discussion of the Prior Art

Shaving razors have been known in a variety of forms. Individuals employ shaving razors of various designs to tackle a variety of shaving challenges. These challenges include shaving not only broad/open and relatively flat areas of hair such as the areas of the cheeks, chin and neck, but also providing a precise and accurate ability to trim and sculpt smaller, more confined and discreet areas of hair such as the area under the nose and around the nostrils, in chin clefts, around skin scars, blemishes and skin imperfections, and on the edges of sideburns, mustaches and beards.

For example, when shaving the open areas of the cheeks or neck, the individual makes broad strokes to remove large patches of facial hair by holding the handle and moving the razor, with the blades contacting the skin, in one direction for cutting the hair extending from the skin. Normally, when the broad/open area shaving is completed, the individual then manipulates the razor to reach into confined areas for finer and more precise grooming.

Current shaving razor designs do not provide individuals the multiple benefits of a convenient, simple and effective means of shaving both the broad/open areas of the body as well as the confined/hard-to-reach areas of the body with the same shaving device.

Modern conventional razors are typically made with one or more parallel strip-like razor blades positioned on a single common working plane and secured upon the head of the razor. A handle extends from the head of the razor. The individual holds the handle and ordinarily scrapes or moves the head of the razor in one direction at a time along the skin such that the blade or blades cuts the hair.

Early razor designs have been made in which the head of the razor holds a single flat razor blade with two sharpened blade edges extending in opposite directions. These early razor designs comprise blade edges spaced apart from one another on opposite sides of the head of the razor. A first blade edge is used until dull, filled with lather or cut hairs, becomes damaged, i.e., the first blade edge is no longer efficient and/or safe to continue cutting hair. Once the first blade is deemed worn, the individual manually rotates the head of the razor 180 degrees to present a second, i.e., opposite of the first blade edge, blade edge toward the skin. Such a single replaceable razor blade having two sharpened edges and mounted within a head of a razor that can be opened and closed was one time very common, and it provided the individual with twice the blade life, i.e., each blade had opposing usable sharp edges. In addition, the first and second blade edges of these designs proved particularly effective for trimming and sculpting facial hair as it was easy to maneuver the single blade edge into confined, hard-to-reach areas of the face, for example, around nostrils, in crevices such as chin clefts, and the like. However, each of the first and second blade edges dulled easily as single blades and therefore sometimes did not deliver a close, smooth and comfortable shave.

In recent years, typically developed and available razor blade systems comprise at least two or more parallel strip-like razor blades positioned closely to one another on a common working plane. Several current systems have three cutting blades on the working plane, and it is possible to add a fourth and successive blades to the razor head assembly. These parallel-blade constructions are used in shaving systems that may be, for example, a disposable shaving cartridge adapted for coupling to or uncoupling from a reusable razor handle, or a shaving head which is integral with a razor handle so that the complete razor is discarded as a unit when the blade or blades become dulled. In many of these systems, the parallel strip-like razor blades are encased in a razor head or cartridge which provides a fixed orientation of the blades to the skin through the use of leading, trailing and glide surfaces which define a working plane of the razor head. These various surfaces of the head all bear against the skin being shaved, and thus ensure the sharpened edges of the blade strips are presented at the proper angle to skin being shaved. In the case of each of these parallel strip-like razor blade systems, the first blade is intended to give a rough cut, and the second or successive blades give a closer cut to provide the individual being shaved with a closer, smoother shave.

Many conventional razors for shaving have a handle or a hand grip structure with means for securing a replaceable razor blade cartridge to it. The handle may also be disposable or it may be essentially permanent and meant to be re-used with many replacement cartridges. These cartridge razor systems are often desirable, in that a more expensive, ergonomic permanent handle, which can be reused multiples of times, can be provided and used in conjunction with a much less expensive replaceable cartridge containing the razor blades. The razor blades in such replaceable cartridges dull fairly rapidly with use and thus they are frequently replaced, typically after just a dozen or fewer shaves. A variety of techniques and cartridge structures have been developed to allow the entire razor head to be readily replaced by the individual.

Razors having a fixed relationship between the head of the razor and the handle require considerable maneuvering on the part of the individual in order to maintain the razor system at its optimum attitude on the individual's face, particularly when negotiating areas such as the jaw line, where there are rapid changes in facial contour. To provide improved shaving characteristics, many razors have been provided with a pivoting head or cartridge, which is preferred by some users of manual safety razors.

In such a pivoting head or cartridge structure, the portion of the handle nearest the cartridge typically includes one or two spring-loaded mechanisms. The first spring-loaded system is used to return the pivoting head to its center or at-rest position. The second spring-loaded system is provided if the razor has a removable cartridge. Wherein there is a removable cartridge, the cartridge is typically held onto the handle by two pivot pins or bearing surfaces which engage in an interlocking manner with complementary sockets or arcuate slot structures located on the bottom of the cartridge. Since the handle can be re-used over and over, it is more economical to equip the essentially permanent handle with a more expensive mechanism for providing this spring-loaded pivoting, attachment structure than could be economically built into the disposable cartridge which is frequently replaced. This approach results in a cartridge having fewer spring-loaded components resident on it, thus reducing its cost.

Conventional razors typically comprise a guard member, a platform member and a cap member between which the razor blade or blades are sandwiched when the razor is ready for use. The handle, the platform, the guard member and cap member traditionally are all fixed relative to one another. The razors may be provided with a single, double or triple-edged blades. In recent decades, the entire shaving unit or head has been made to be disposable.

More specifically, a modern conventional razor cartridge typically has a blade platform or seat having formed thereon a guard bar for smoothing the skin adjacent to the cutting edge or edges of the razor blade during shaving. The razor's guard structure is disposed in fixed relation to the cutting edges and includes a back portion upstanding from the blade support portion. The guard and back portions define parallel opposite lengthwise edges of the platform member. As such, they define a single "working plane" which bears against the skin and controls the angle and distance at which the sharpened edges of the blades are allowed to bear against a section of the skin to be shaved as the blade is moved across the skin. In addition, the sharpened corners of the razor blade strips are guarded by the configuration of the head or cartridge structure for the safety of the individual, so the blade corners do not cut the skin of the individual.

The blade platform may include a channel which can be used to re-load the cartridge if the cartridge is reusable. A cap is provided to complete the main supporting structure of the razor cartridge. The blades are often retained on the blade platform by the passing of plastic pins through holes in the blades and then passing the pins into a heading which forms part of the cap. In this manner, the cap holds the blade or blades in place. The cap typically is pinned, fused, cemented or otherwise bonded together with the blade seat structure and captivates the blade or blades, and any spacers between them.

To provide even greater shaving efficacy and comfort, many current razor designs also contain small ribbed strips that run the length of the shaver head, parallel to the cutting blade or blades, intended to first engage or "grab" the hair before it is cut by the first and successive cutting blades. This ribbed strip, whose ribs are sometimes referred to as "microfins" or "fingers," is generally located at the leading edge of the razor head, in a position forward of or ahead of the first cutting blade. It is the first element or member on the shaver head to engage the individual's skin surface in a shaving stroke.

In addition to the ribbed skin-engaging strip, an additional shaving-aid strip has often been affixed to the working plane of the razor in close proximity to the working edges of the blades—often at the trailing edge of the razor head, located rearwardly, behind or after the last cutting blade in the multiple blade razor design. It is the often last element or member on the shaver head to engage the individual's skin surface in a shaving stroke. This solid water-soluble shaving-aid strip, or "glide" strip as it is sometimes called, contains a lubricant, whisker softener, razor cleaner, medicinal agent, cosmetic agent or a combination of the above as part of the razor head. The shaving-aid strip may be a shave-aiding agent combined with a solid, water-soluble micro-encapsulating or microporous structure which retains the agent. The strip can be the agent itself when it is a water-soluble solid.

Together, the razor head's platform, guard structure, blade edges, cap, skin-engaging microfins and the lubricating glide strip all cooperate with the skin to define shaving geometry and efficacy and are intended to give the individual a safe, close and comfortable shave. See; for example, U.S. Pat. No. 5,956,848 to Tseng et al., wherein a razor head assembly having the above described characteristics is disclosed.

However, there are unexpected deficiencies with modern conventional blade designs. Unlike earlier razor designs such as the single blade edge razor described above that did not incorporate either the ribbed skin-engaging strip to grab hair or the lubricating glide strip to provide additional comfort or skin conditioning, the design of the multiple blade razor head containing these additional elements dictates that the cutting blade or blades be significantly offset from the parallel edges of the razor head. When the cutting blade or blades are significantly offset in this manner, they are positioned near the center of the shaving head and away from the leading or trailing edges of the shaver head. While this design in general offers the individual a closer and more comfortable shave for shaving broad areas of the face, it also necessarily creates a deficiency and usability shortcoming by limiting the individual's ability to use the shaver to reach into confined, hard-to-reach and delicate areas of the face and body such as under the nostrils, in chin clefts, around mustaches and on sideburn and beard edges and the like with precision and accuracy. In practice, the edges of the razor cartridge holding the ribbed strip and lubricating strips "get in the way" or "block" the blade cutting edge's access to confined body areas. The individual must then attempt to push and wedge the razor cartridge into the confined area. This difficult maneuvering process of the razor is cumbersome for many individuals and often results in an inability to cut the targeted hair. Additionally, in the case where the individual is overly persistent in attempting to position the razor into these confined areas, skin irritations and sometimes skin abrasions or lacerations may be produced. See, for example, U.S. Pat. No. 5,784,790 to Carson III et al., wherein a razor head assembly that exhibits the characteristics and shortcomings described above is disclosed.

Thus, it may be said, that the new generation of multiple-blade razors comprising two, three or more parallel in-line blades and comfort/lubricating strips provide superior shaving closeness and comfort in broad open areas but make shaving confined, hard-to-reach areas difficult and cumbersome. Further, earlier generations of single blade razor systems provide the benefits of precision trimming and sculpting control in confined, hard-to-reach areas but do not optimize broad-area shaving comfort and closeness.

There have been previous attempts at trimming and sculpting razors, but none has overcome deficiencies set forth above. It would be desirable in many instances, for example, to have a razor design that can deliver the benefits of closeness and comfort that modern multi-blade razors (with their ribbed skin-engaging and lubricating strips) provide while at the same time having that same razor deliver greater efficiency and effectiveness for highly maneuverable, precision shaving that was at one time more readily possible with early single blade razor designs that were ideal for shaving in confined areas that require trimming, edging and sculpting on the individual's body. That is, it would be convenient to provide a low-cost, single-head, multi-blade razor construction which is usable and effective in all areas of the face and body and meets all the individual's facial and bodily shaving challenges and needs.

Limited efforts have been made to address this shortcoming. While several types of razor designs that can shave both broad/open and relatively flat areas as well as confined, hard-to-reach areas with the same device have been proposed, none of the proposed designs offer an optimal solution that is at the same time affordable, convenient, easy-to-use and provides an individual-experience consistent with the shaving razor systems that are presently commercially available and in public use.

There are several known shaving devices that have been proposed to overcome the deficiencies set forth above. Following are examples of such devices and a discussion of how each of the proposed devices fail to effectively and economically meet the needs of shaving both broad/open and relatively flat areas in addition to confined, hard-to-reach areas with the same device.

U.S. Pat. No. 6,052,905 to Branchinelli, et al. discloses a dual-headed razor system having a single handle structure having an additional separate built-in telescoping mini-handle, with a pair of separately detachable razor heads each separately connected to the handle and telescoping mini-handle. Each head has a pair of blades mounted on it. The razor system is said to be useful in shaving and sculpting an area of hair on an individual. In this design, there are two separate razor heads, which means the structure is bulky and has limited maneuverability. Further, using two razor heads add significantly to the cost of the razor approach by requiring two cartridge support structures and two cartridges. More significantly, the complex mechanical handle structure having movable parts and a telescoping member adds greatly to the manufacturing cost of the approach.

U.S. Pat. No. 4,989,328 to Sokoloff discloses a razor assembly that includes two separate razor heads mounted on a single "Y"-shaped handle where each head is facing in the opposite direction of the other. One razor head attached to one branch of the "Y" is adapted to hold a conventional size blade. The other razor head attached to other branch of the "Y" is adapted to hold a smaller blade for trimming. The individual chooses between either razor head by rotating the handle with his fingers. So, as with the Branchinelli design, there are two separate razor heads, which means the structure is bulky and has limited maneuverability. Further, using two heads adds significantly to the cost of the razor approach by requiring two cartridge support structures and two cartridges.

U.S. Pat. No. 6,499,218 to Rocha discloses a razor having a shaving head which includes dual blades with multiple shaving edges having different lengths and/or shapes to provide a selection of shaving edges for various types of hair encountered on the body of an individual. Each blade has straight and convex shaving edges on two sides thereof as well as blade extensions having shorter straight and convex shaving edges on two ends. The razor further includes a handle with a conduit located therein in communication with the shaving head whereby water can travel through the handle, into the shaving head and past the blades to dislodge debris. Further, the razor is equipped with a slidable plunger which is slidable in the conduit so that oils, creams or liquids can be applied through the shaving head. While the approach presented embodies a single-head razor approach, the four-sided blade in the Rocha design would add significantly to the cost of manufacturing the blade cartridge. Further, the complex nature and multi-function use of the razor handle containing a water-flushing system and reservoir and plunger for loading and dispensing oils, creams and other liquids make the system cumbersome to use and costly to produce.

U.S. Pat. No. 4,663,843 to Savage discloses a shaving razor that utilizes a trailing blade aligned along the longitudinal axis of the razor's shaving head for trimming and at least one leading blade for primary shaving. The cutting edge of the leading blade is aligned diagonally to the cutting edge of the trailing blade and therefore slices through the hair or beard at a different angle of attack than does a conventional blade. While the approach presented embodies a single-head razor approach, the angled blade configuration in the Savage design would add significantly to the cost of manufacturing the blade cartridge. Further, only one of the blades on the razor head is used for broad-stroke shaving and therefore does not offer the individual the optimal and effective means for shaving broad areas of the face afforded by a razor with a plurality of blades on a common plane specifically designed for that purpose.

U.S. Pat. No. 4,285,124 to Diakonov discloses a razor for trimming beards and mustaches around their edges. The design comprises a razor blade, a head for holding the razor blade, and a blade support all having complementary tapered ends which taper from an edge opposite the cutting edge to a point just above the end of the cutting edge. The tapered ends permit the individual of the razor to trim his beard or mustache beneath his nostrils. The illustrated device also includes a retractable miniature safety razor which is movable from a first position where it is retracted behind the head to a second position where it is deployed above the head for use in trimming the area beneath the center of the individual's nose. The Diakonov design is primarily used for trimming beards and mustaches and does not offer the individual an optimal and effective means for shaving broad areas of the face. Further, the complex nature and multi-function use of the razor handle containing a retractable system and multiple razor heads makes the system complicated to use and costly to produce.

U.S. Pat. No. 5,778,535 to Ledesma discloses a hand held razor configured to provide a cutting pattern suitable for penetrating into and shaving corners and similar areas of a individual's face providing restricted access to razors. The razor has a head holding three blades disposed in parallel, spaced apart relation occupying a single plane, and a handle. The three blades are of different lengths, and are held centered on the head in order of progressively increasing length, with the shortest blade disposed at the bottom of the head. While the Ledesma design offers the individual some improved ability to shave restricted areas, it does not optimize the razor's ability to effectively, rapidly and efficiently shave the broad, open skin surfaces of the face.

Thus, improvements in dual-purpose shaving and trimming/sculpting razors are still needed as the prior art has not properly solved the deficiencies of effectively and economically shaving both broad/open and relatively flat areas in addition to confined, hard-to-reach areas with the same device.

SUMMARY

The present invention overcomes the trimming and sculpting efficacy shortcomings of prior shaving razor system designs while at the same time retains the benefits of said designs; that is, providing closeness and comfort in shaving broad areas of the face. In practice, the present invention provides an individual the working elements of both a multi-blade razor and a single blade razor, all in single shaving device design, and delivers the benefits generally and exclusively heretofore afforded by each.

The present invention is therefore concerned with providing an improved shaving and trimming/sculpting razor system, head and cartridge by providing a novel blade cartridge constructed to satisfy the aforementioned needs. In particular, exemplary embodiments of the present invention comprise a razor cartridge construction having a base structure that is handled in a manner generally similar to popular multi-blade razor designs, but further comprises a separate stand-alone single-edge blade added to the top or top-back edge of the shaving cartridge. Accordingly, in exemplary embodiments of the present invention, on a single razor head, a primary group of blades on a first common plane on the front face of the shaver head is utilized for shaving broad, relatively flat areas of facial hair, as is consistent with existing multi-blade designs, and, on the same cartridge head, there is comprised a secondary blade group positioned on a second plane, wherein the second plane is a separate and distinct working plane ideally for precise shaving in confined, contoured, hard-to-reach areas, especially around the nostrils, in crevices such as chin clefts, and around the edges of sideburns, mustaches and beards.

Therefore, the present invention substantially reduces the disadvantageous features inherent in both single blade and multiple blade razor designs by providing the individual with a convenient, easy-to-use and effective all-in-one, dual-purpose razor for shaving broad areas and trimming/sculpting confined areas of facial and/or body hair.

BRIEF DESCRIPTION OF THE DRAWINGS

Various other objects, features and advantages of the present invention will become more fully appreciated as the same becomes better understood when considered in conjunction with the accompanying drawings, in which reference characters designate the same or similar parts throughout the several views.

DETAILED DESCRIPTION

Figure 1:
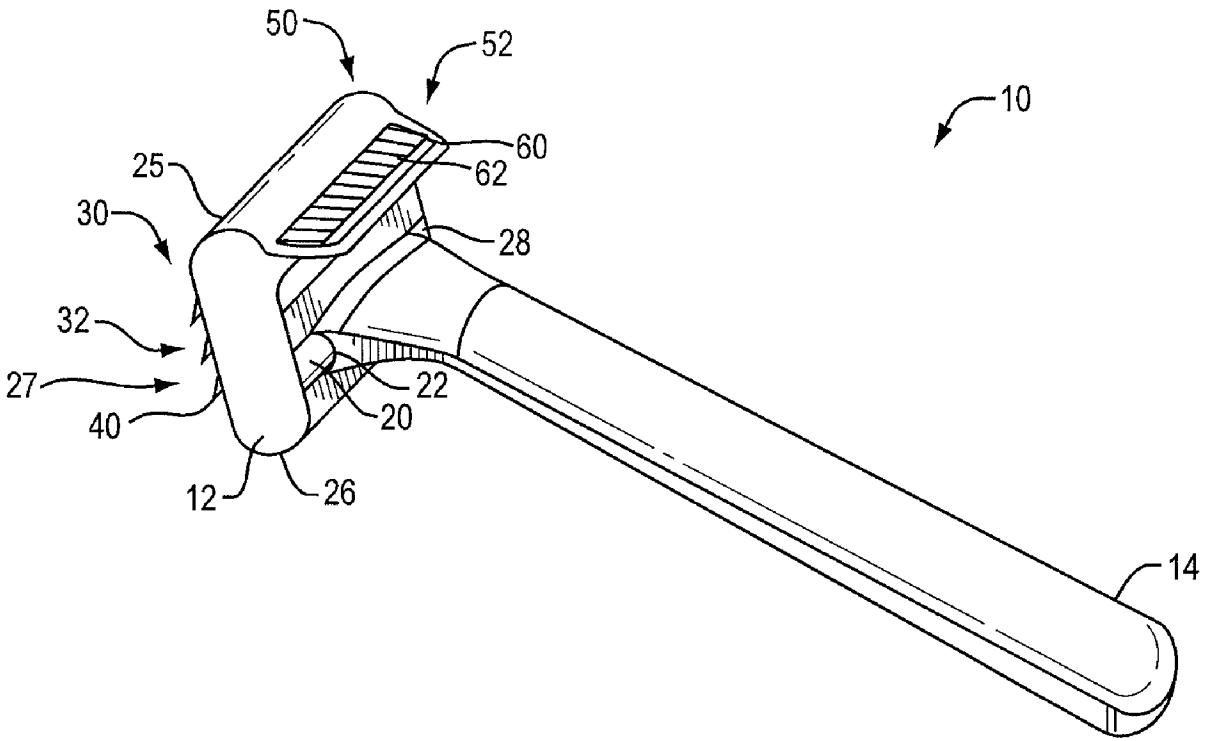
FIG. 1 is a top perspective view of an exemplary embodiment of the razor system of the present invention.

Turning now descriptively to the drawings, in which similar reference characters denote similar elements throughout the several views, the Figures illustrate the razor of the present invention. With regard to the reference numerals used, the following numbering is used throughout the various drawing figures.

LEGEND

10-18 major razor system components
20-28 other razor cartridge items
30-48 primary working plane and primary blade group components
50-68 secondary working plane and secondary blade group components
70-78 alternate embodiments of the secondary blade group
10 razor system of the present invention
12 razor head cartridge
14 razor handle
20 channel for attaching razor cartridge to handle
22 clip for attaching handle to razor cartridge
23 shaving aid strip
24 top-back surface edge of razor head cartridge
25 top surface of razor head cartridge
26 bottom surface of razor head cartridge
27 front surface of razor head cartridge
28 back surface of razor head cartridge
30 primary working plane for broad stroke shaving of open, flat surfaces
32 primary blade group comprising a plurality of cutting blades
34 blade platform of primary blade group
36 cap of primary blade group
38 guard bar of primary blade group
40 razor blades of primary blade group
42 cutting edge of primary blade group razor blade
50 secondary working plane for trimming and sculpting confined areas
52 secondary blade group comprising a single cutting blade
54 blade platform of secondary blade group
56 cap of secondary blade group
58 guard bar of secondary blade group
60 razor blade of secondary blade group
62 cutting edge of secondary blade group razor blade
70 two short razor blade strips of the secondary blade group positioned at opposed ends of the secondary blade group structure
72 single elongated V-shaped razor blade strip extending the length of the secondary blade group structure
74 single elongated convex-shaped razor blade strip extending the length of the secondary blade group structure
76 a single shortened razor blade strip positioned in the middle of the secondary blade group structure.

As disclosed in the prior art reviewed above, prior art designs fail to disclose the exemplary embodiments of the present invention comprising shaving system or device having a single integrated razor head or cartridge that can optimally tackle the variety of shaving challenges and needs encountered by an individual in a single system or device. None of the above mentioned prior art discloses a razor head supported by a razor handle wherein the razor head has two blade groups and one of the blade groups is located on the top or top-back edge of the head and facing away from the other front-facing blade group.

Thus, it is desirable to provide an improved, affordable shaving system, structure and cartridge design that allows the individual to shave safely, effectively and efficiently in order to meet all shaving challenges and needs. To overcome the shortcomings of the prior art, thereby improving the shaving device for safe and effective trimming and sculpting control in the shaving experience, while at the same time maintaining the "closeness and comfort" benefits of recent multi-blade razor system designs, the herein described invention has been designed.

The present invention is therefore concerned with providing an improved shaving and trimming/sculpting razor system, head and cartridge by providing a novel blade cartridge constructed to satisfy the aforementioned needs. In particular, exemplary embodiments of the present invention comprises a razor cartridge construction comprising a base structure that is handled in a manner generally similar to popular multi-blade razor designs, but further comprises a separate stand-alone single-edge blade added to the top or top-back edge of the shaving cartridge. Accordingly, in exemplary embodiments of the present invention, on a single razor head, a primary group of blades on a first common plane on the front face of the shaver head is utilized for shaving broad, relatively flat areas of facial hair, and, on the same cartridge head, there is comprised a secondary blade group positioned on a second plane, wherein the second plane is a separate and distinct working plane ideally for precise shaving in confined, contoured, hard-to-reach areas, especially around the nostrils, in crevices such as chin clefts, and around the edges of sideburns, mustaches and beards.

More specifically, the razor head or cartridge of the exemplary embodiments of the present invention comprises a primary group of blades comprising two or more substantially parallel strip-like razor blades on a primary front face or front working plane, wherein the two or more parallel strip-like razor blades are positioned closely to one another. The primary group of blades is preferably encased in the razor head or cartridge in a manner providing a fixed orientation of the blades to the skin through leading and trailing and glide surfaces which define the front working plane of the razor head. These various surfaces of the primary front face or front working plane bear against skin being shaved, and therein substantially ensure the sharpened edges of the blade strips are presented at the substantially proper angle to the skin being shaved.

The razor head or cartridge additionally comprises a secondary blade group comprising one or more strip-like razor blades on a secondary face or a second working plane positioned on the top or top-back edge of the razor head. The secondary blade group is encased in or fused to the razor head or cartridge in a manner providing a fixed orientation of the blade to the skin through the use of thin-profile leading and trailing glide surfaces which define a second working plane of the razor head. These various surfaces of the secondary face or second working plane bear against the skin being shaved, and thus substantially ensure the sharpened edges of the blade strip is presented at the substantially proper angle to skin being shaved. A handle extends from the head of the razor.

The individual holds the handle extending from the razor head or cartridge with the primary working plane comprising the primary group of blades facing the skin and ordinarily scrapes or moves the head of the razor in a direction along the skin such that the blades will cut the unwanted hair. The primary group of blades on the primary front face of the razor cartridge shaves the broad, relatively flat areas of facial and body hair. Once the individual employs the primary blade group to remove all of the broad, relatively flat areas of facial or body hair, the individual can then manually rotate the handle extending from the razor 180 degrees to present the secondary blade group to the skin to reach into confined, contoured, hard-to-reach areas to remove facial or body hair such as the hair around the nostrils, in crevices such as chin clefts, and around the edges of sideburns, mustaches and beards.

In the course of the shaving regimen, the individual can similarly select either the primary "broad-stroke" blade group or the secondary "trimming/sculpting" blade group at any time during the shaving experience. Because both blade groups, each with their own distinct function, are comprised on the same shaving head, the shaving system is highly maneuverable, versatile, effective and convenient in meeting all of the individuals shaving challenges and needs with a single integrated device.

In exemplary embodiments of the present invention, the razor system removes unwanted hairs from either wet or dry skin, wherein wet skin is defined as skin that has been treated with one or more of water, soap, lotion, cream, lubricant, ointment, and mixtures thereof. Preferably, the skin to which the razor system of the exemplary embodiments of the present invention is in contact with in which to remove hair is wet.

In exemplary embodiments of the present invention, the razor comprises a primary group of blades and a secondary group of blades, wherein the primary blade group is on a different, directionally-opposed working plane than a second plane on which is comprised of the secondary blade group.

The primary group of blades according to the exemplary embodiments of the present invention comprises one or more blades substantially parallel to one another in the front working plane. Blades of the primary group of blades may be of different lengths and widths, relative to one another and relative to other razor systems. Preferably, the blades of the primary group of blades are of about the same length and width relative to one another in the same razor system.

The secondary group of blades according to the exemplary embodiments of the present invention comprises one or more blades substantially parallel to one another in the second working plane. Where more than one blade comprises the secondary group of blades, it is preferred that the more than one blade is substantially same width and length as the other more than one blade(s) of the secondary group of blades.

In a preferred embodiment of the present invention, the secondary group of blades comprises two blades of substantially the same width and length. In a more preferred embodiment, the secondary group of blades comprises one blade. In a further preferred embodiment, the secondary group of blades is a group of blades that is separate and distinct from the primary group of blades. That is, each group has its own blade or blades that are separately mounted within the cartridge.

In exemplary embodiments, a leading-edge blade guard on the secondary blade group comprises a thin profile to allow the distance between the cutting blade and the individual's skin to be optimally minimized to facilitate shaving in confined hard-to-reach areas of the face.

According to the exemplary embodiments of the present invention, the razor cartridge is preferably replaceable and disposable.

Further, wherein the razor cartridge of according to the exemplary embodiments is replaceable and disposable, it is preferred that the razor cartridge attach to a conventional razor blade handle in place of conventional razor cartridges.

In another exemplary embodiment of the present invention, the razor cartridge is permanently attached to the handle, therein comprising a disposable razor system, wherein both the handle and attached razor cartridge are disposable.

In another exemplary embodiment of the present invention, the head of the razor is connected to the handle via a cam system such that the razor cartridge may pivot to more easily follow the contours of the body part being shaved.

The razor system according to the exemplary embodiments of the present invention preferably removes hair from any human and animal body part. Preferably, the razor system of the present invention removes hair from humans of either gender.

To the accomplishment of the above, this invention may be embodied, for example, in the forms illustrated in the accompanying drawings, with attention being called to the fact, however, that the drawings are not to be interpreted in a limiting sense, and that changes may be made in the specific construction illustrated and described within the scope of the appended claims.

Turning now descriptively to the drawings, in which similar reference characters denote similar elements throughout the several views, FIGS. 1 through 9 illustrate exemplary embodiments of the razor or parts thereof of the present invention which is indicated generally by the numeral 10.

The razor 10 is shown in FIG. 1 and comprises a head 12 that is integrally connected to a handle 14. It is preferred that the head 12 be of a standard size, i.e., a size similar and/or substantially close to the dimensions of presently available razors. The handle 14 grips the razor head 12 and the handle comprises a clip 22 for attaching to a channel 20 of the razor head 12 for coupling on a back side of the razor head 12 thus creating a working connection between the two elements. The top surface of the razor head cartridge is illustrated as numeral 25, the bottom surface of the razor head cartridge is illustrated as numeral 26, the front surface of the razor head cartridge is illustrated as numeral 27, and the back surface of the razor head cartridge is illustrated as numeral 28.

The razor head 12 is comprised of a primary working plane 30 comprising a primary blade group 32. The primary blade group 32 comprises one or more razor blade strips 40 to shave broad and relatively flat areas of the face or body. The razor head 12 further comprises a secondary working plane 50 comprising a secondary blade group 52. The secondary blade group 52 comprises one or more elongated razor blade strips 60 to precisely shave confined, hard-to-reach areas of the skin.

Figure 2:
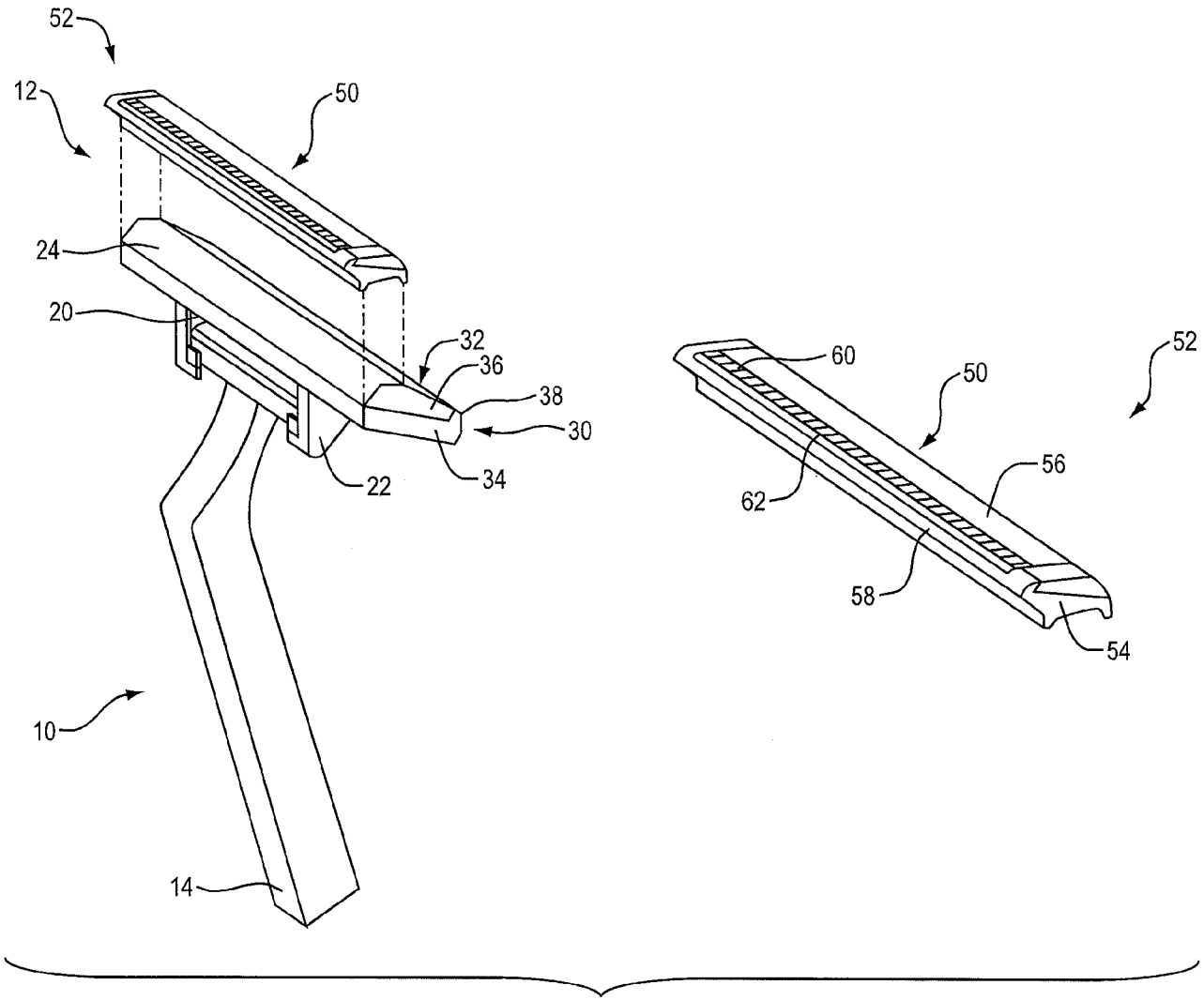
FIG. 2 is a top perspective view of an exemplary embodiment of the razor system of the present invention showing the position of a secondary blade group with accompanying isolated detail of the secondary blade group.

FIG. 2 illustrates a top perspective view of razor 10 indicating the relative positions, in exploded fashion, of the primary blade group 32 of the primary working plane 30 and the secondary blade group 52 of the secondary working plane 50 on the razor head cartridge 12. The secondary blade group 52 comprising the secondary working plane 50 is constructed of a blade platform 54, a guard bar 58, and one or more elongated razor blade strips 60, each strip comprising a cutting edge 62, and a cap 56, all fused, cemented or otherwise bonded together.

The primary blade group 32 comprising the primary working plane 30 is comprised of a blade platform 34, a guard bar 38, one or more elongated razor blade strips 40 (not shown), and a cap 36, all fused, cemented or otherwise bonded together. The secondary blade group 52 is attached, fused, cemented or otherwise bonded, along a top-back edge 24, to the primary blade group 32 comprising the primary working plane 30 to preferably create an permanent, integrated one-piece razor head 12 having two separate and distinct blade groups, 32 and 52. The composite razor head cartridge 12 is attached permanently or replaceably to the handle 14 via a connection between the clip 22 on handle 14 and a channel 20 located on the back side of razor head cartridge 12. Together, these elements comprise the razor system 10 of an exemplary embodiment of the present invention.

Figure 3:
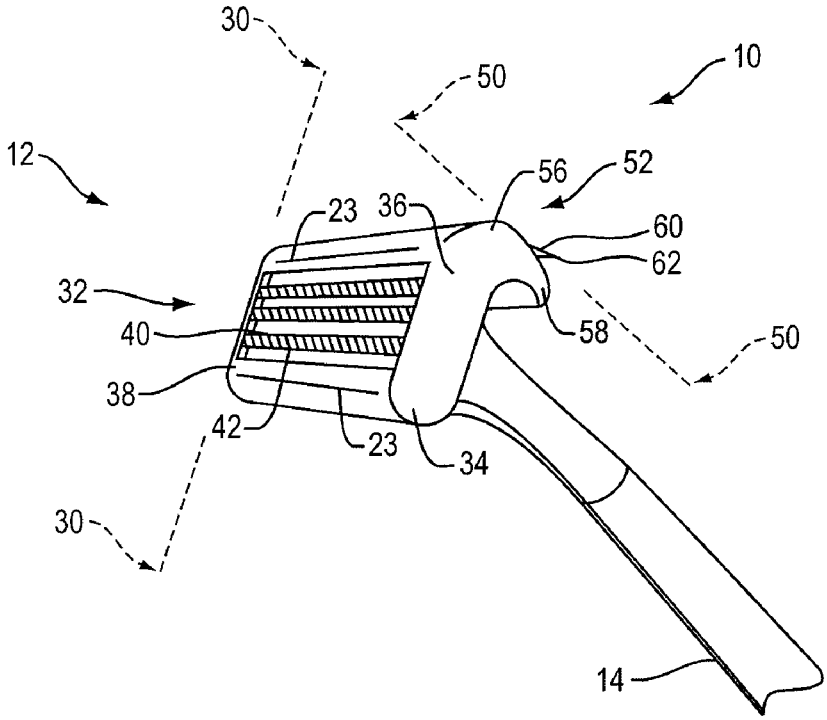
FIG. 3 is a side perspective view of an exemplary embodiment of the razor system of the present invention showing the position of a primary working plane and primary blade group.

FIG. 3 shows a side perspective view of the razor 10 indicating the relative positions on the razor head cartridge 12 of the primary working plane 30 relative to the secondary working plane 50. The primary working plane 30 comprising the primary blade group 32 is comprised of one or more elongated parallel razor blade strips 40 comprising cutting edges 42 facing outward from the primary working plane 30. The primary blade group 32 comprised of the razor blade strips 40 is further comprised of a blade platform 34, a guard bar 38 and a cap 36, all fused, cemented or otherwise bonded together. In an exemplary embodiment, one or more lubricating shaving aid strips 23, located rearwardly or forwardly of the razor blade strips 40 of the primary blade group 32 is attached to the primary working plane 30. Joined to the integrated primary blade group structure 32 at the top-back edge of the razor head cartridge 12 is the secondary blade group 52 comprising a secondary working plane 50 for trimming/sculpting and precision shaving. The drawing illustrates the secondary blade group 52 comprising the razor blade strip 60 comprising a cutting edge 62 facing outward and away from the primary working plane 30. The integrated razor head cartridge 12 is attached permanently or replaceably to the razor handle 14.

Figure 4:
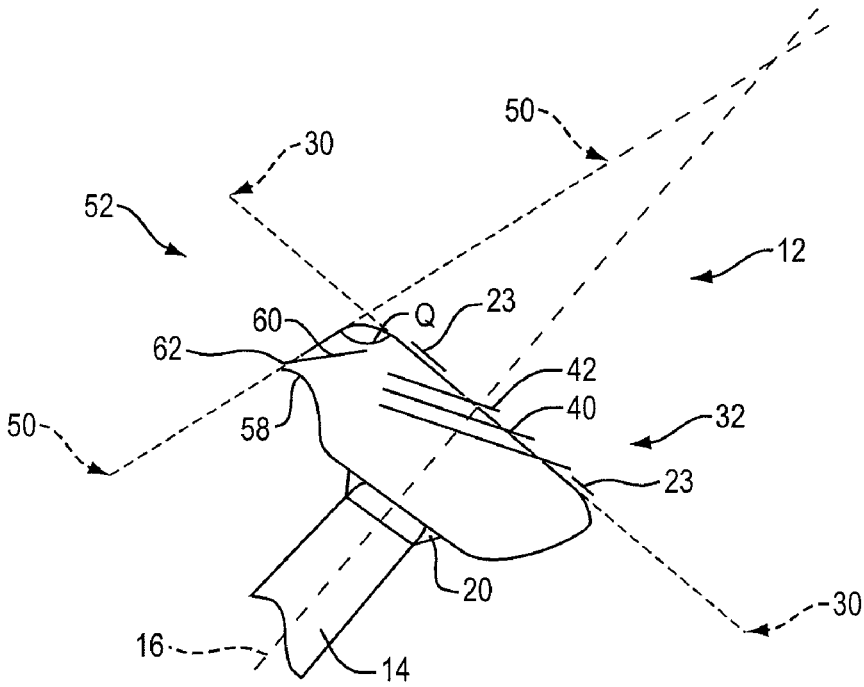
FIG. 4 is a side view of the razor of an exemplary embodiment of the present invention showing the positions of the primary blade group and secondary blade group relative to one another.

FIG. 4 shows a simplified side view of the razor head cartridge 12 indicating the relative positions of the primary working plane 30 and its respective primary blade group 32 relative to the secondary working plane 50 and secondary blade group 52, as well as the relationship of both working planes to the handle axis 16. The handle axis 16 is defined by at least a portion of razor handle 14; where the razor handle 14 has proximal and distal portions that are at an angle to each other (see, for example, the razor handle of FIG. 2), the handle axis 16 could be defined by either portion. The geometric relationship between the primary working plane 30, secondary working plane 50, and handle axis 16 as shown in FIG. 4 represents another aspect of the present invention. In particular in the illustrated embodiment, the primary 30 and secondary 50 working planes each intersect with the handle axis and intersect with each other. As illustrated, the planes 30, 50 intersect so as to form a line of intersection (extending into the page of the Figure) that is transverse and orthogonal to the handle axis 16. The planes 30, 50 further intersect at an angle Q that is greater than 0 degrees and less than about 150 degrees, more preferably between about 75 degrees and 135 degrees, and more specifically in the illustrated embodiment, between about 105 and 120 degrees. In addition, the plurality of blades in the primary blade group 32 are angled, as described above, at an acute angle of less than about 45 degrees with respect to the primary working plane 30 in the direction of broad area shaving. The blade or blades of the secondary blade group 52 can similarly be provided at an acute angle of less than about 45 degrees with respect to the secondary working plane 50 in the direction of trim shaving. This geometry, while not required for certain aspects of the invention, can be beneficial in providing a razor that can comfortably be used for broad area shaving in a first orientation and for trim shaving in a second orientation that is rotated about the handle axis by 180 degrees from the first orientation. This is particularly true when at least a portion of the handle 14 is provided with a symmetric shape that makes it easy and comfortable to handle in either orientation.

Figure 5:
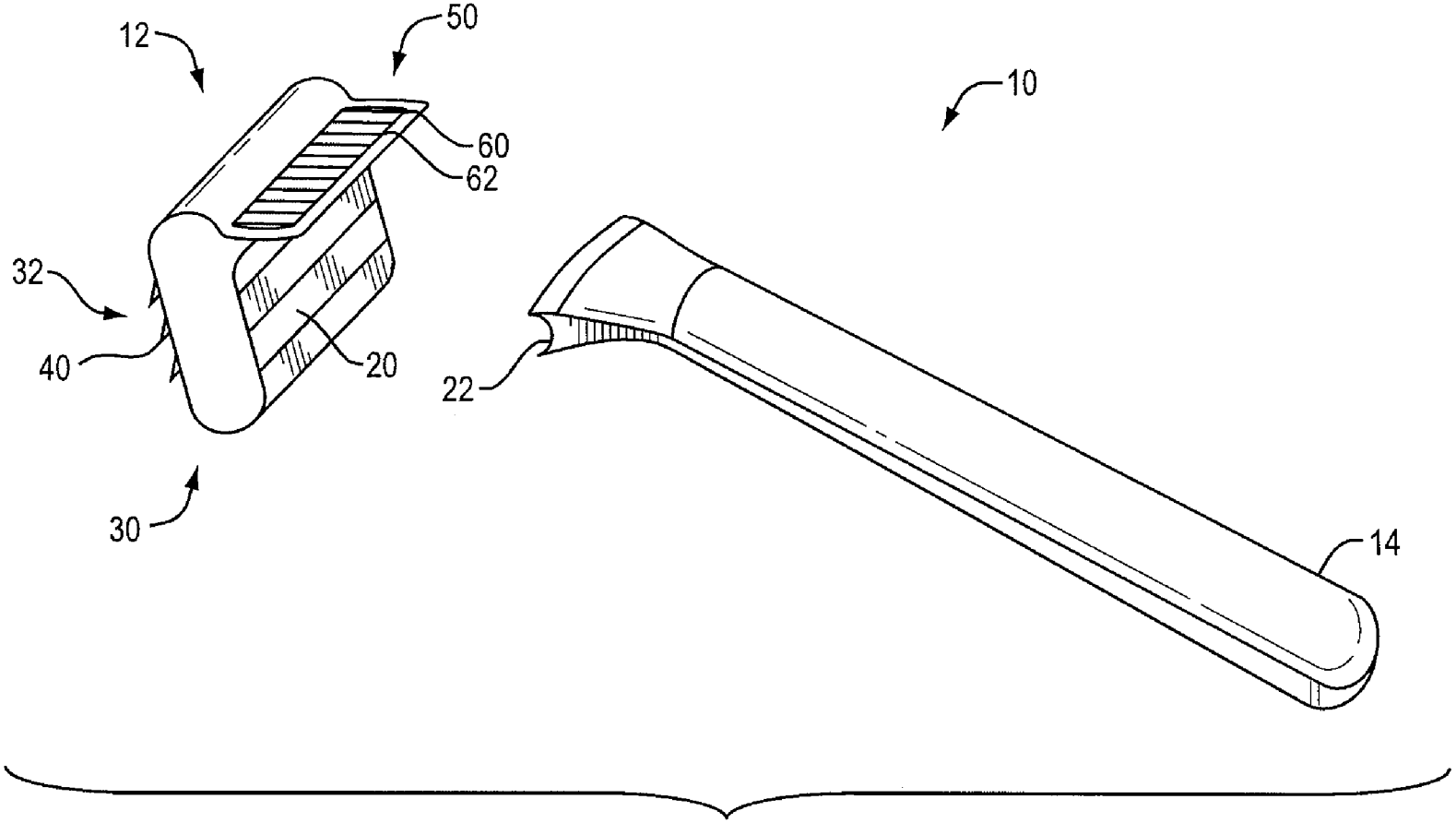
FIG. 5 is a top perspective view of an exemplary embodiment of the razor system of the present invention showing the system comprised of a razor head cartridge and a handle.

FIG. 5 shows a view of the razor system 10 in a manner similar to that described by FIG. 1, with the razor head cartridge 12 separate from the razor handle 14, indicating a razor system comprising a permanent handle with a disposable and replaceable razor head cartridge.

FIGS. 6 through 9 show top perspective views of each of several alternate embodiments of the secondary blade group 52 isolated from the razor head cartridge 12. These exemplary embodiments of the secondary blade group 52, as is indicated for the preferred embodiment of the secondary blade group 52 described and shown in FIG. 2, would be similarly attached, fused, cemented or otherwise bonded, along the top-back edge 24, to the primary blade group 32 comprising the primary working plane 30 to create an permanent, integrated one-piece razor head cartridge 12 having two separate and distinct blade groups 32 and 52.

Figure 6:
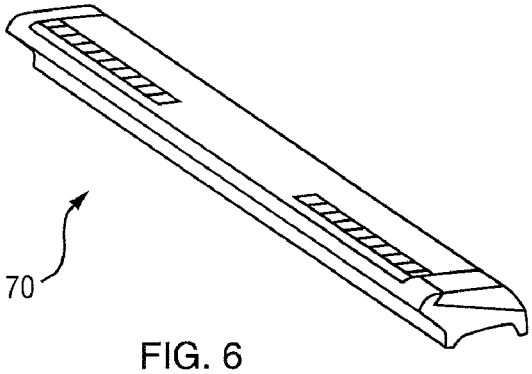
FIG. 6 is a top perspective view of an another exemplary embodiment of the secondary blade group of the razor system of the present invention showing two short blades positioned at opposed outer edges of the secondary blade group structure.
Figure 7:
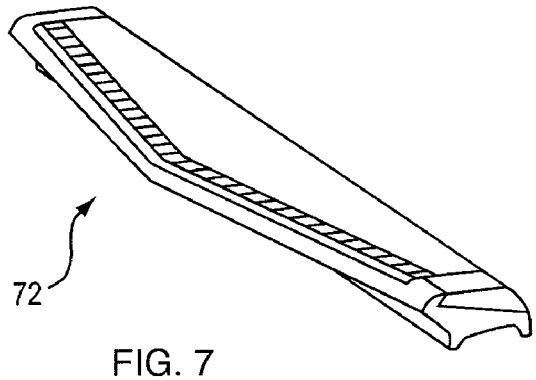
FIG. 7 is a top perspective view of an another exemplary embodiment of the secondary blade group of the razor system of the present invention showing a single V-shaped blade.
Figure 8:
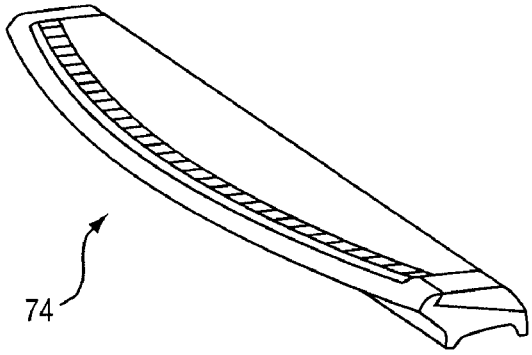
FIG. 8 is a top perspective view of an another exemplary embodiment of the secondary blade group of the razor system of the present invention showing a single convex blade.
Figure 9:
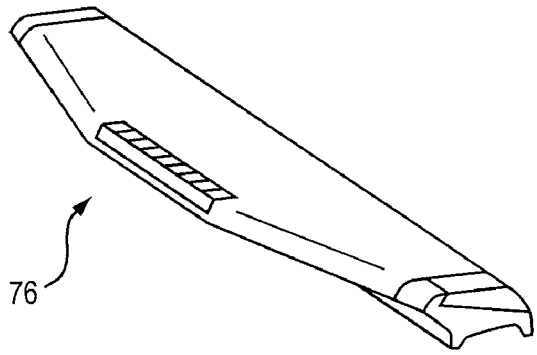
FIG. 9 is a top perspective view of an another exemplary embodiment of the secondary blade group of the razor system of the present invention showing a single short blade positioned in the center of the secondary blade group structure.

In particular, in views isolated from the integrated razor head cartridge 12 for the purpose of providing simplified descriptions herein, FIG. 6 shows the exemplary embodiment of a secondary blade group 70 that is comprised of two short razor blade strips positioned at opposing ends of the secondary blade group structure. FIG. 7 shows the exemplary embodiment of a secondary blade group 72 that is comprised of a single elongated V-shaped razor blade strip extending the length of the secondary blade group structure. FIG. 8 shows the exemplary embodiment of a secondary blade group 74 that is comprised of a single elongated convex-shaped razor blade strip extending the length of the secondary blade group structure. FIG. 8 shows the exemplary embodiment of a secondary blade group 76 that is comprised of a single shortened razor blade strip positioned in the middle of the secondary blade group structure.

Each of the alternate embodiments of the secondary blade group 52, shown in FIGS. 6-9 and indicated respectively by the reference numerals 70, 72, 74 and 76, are each constructed in a manner generally consistent with the construction described for the preferred embodiment of secondary blade group 52. That is, each is comprised of blade platform, a guard bar, a cap, and one or a plurality of razor blade strips having a cutting edge, and are all fused, cemented or otherwise bonded together to form an alternate construction of said secondary blade group 52.

The operation of the razor 10 will now be described with reference to the figures. In operation, the razor 10 is adapted for use by the individual as follows:

The individual grasps the handle 14 that holds or is connected to the razor head cartridge 12, with the primary working plane 30 comprising one or more blades of the primary blade group 32 facing and presented to the skin, and ordinarily scrapes or moves the razor head 12 in one direction along the skin so the blades of the primary blade group 32 will cut the hair. This group of blades on the primary working plane 30 of the razor head cartridge 12 is used to shave broad, relatively flat areas of facial or body hair, preferably in a single stroke. Once the individual employs the primary blade group 32 to remove all of the broad, relatively flat areas of facial or body hair, the individual then manually rotates the razor handle 14 180 degrees to present the secondary working plane 50 comprising the secondary blade group 52 comprising the single edge razor blade strip 60 to the skin to reach into confined, contoured, hard-to-reach areas to precisely remove facial or body hair such as the hair around the nostrils, in crevices such as chin clefts, and around the edges of sideburns, mustaches and beards. In the course of the shaving regimen, the individual can similarly select either the primary blade group 32 for "broad-stroke" shaving or the secondary blade group 52 for precision "trimming and sculpting" shaving at any time during the shaving experience. Because both blade groups, each with their own distance function, all reside on the same shaving razor head cartridge 12, the shaving system 10 is highly maneuverable, versatile, effective and convenient in meeting all of the individual's shaving challenges and needs, with a single, all-in-one integrated device.

In the process of shaving hairs, the individual preferably wets or moisturizes the skin to be shaved prior to the start of the shaving process.

From the above description it should be understood that the razor of the present invention overcomes the shortcomings of the prior art devices by providing a razor system which is effectively able to both shave broad, open, relatively flat areas of the skin and trim/sculpt hair in confined, hart-to-reach, sensitive areas of the skin using a single device comprising a single razor head and handle.

Furthermore, the razor of the present invention is simple and easy-to-use, highly maneuverable, versatile and economical in cost to manufacture using well-known, current production methods.

It will be understood that each of the elements described above, or two or more together may also find an application in other types of methods differing from the type described above.

While certain novel features of the present invention have been shown and described and are pointed out in the annexed claims, the present invention is not intended to be limited to the details above, since it will be understood the various omissions, modifications, substitutions and changes in the forms and details of the device illustrated and in its operation can be made by those skilled in the art without departing in any way from the spirit of the present invention.

Without further analysis, the foregoing will so fully reveal the fundamental idea of the present invention that others can, by applying current knowledge, readily adapt it for various applications without omitting features that, from the standpoint of prior art, constitute essential characteristics of the generic or specific aspects of this invention.

The invention claimed is:

1. A method of preparing a razor system having a primary blade group for broad area shaving and a trim blade group for precise shaving, the method comprising:

providing a razor head cartridge having a top surface, a bottom surface, a front surface, a back surface, and a primary blade group having a plurality of razor blades, a primary blade platform, a primary guard bar, and a primary cap configured to provide broad area shaving in a first working plane at the front surface of the razor head cartridge, wherein the plurality of razor blades in the first blade group are angled at an acute angle with respect to the first working plane in a direction of broad area shaving;

providing a secondary blade group having at least one razor blade, a secondary blade platform, a secondary guard bar, and a secondary cap configured to provide trim shaving in a second working plane, wherein the at least one razor blade in the second blade group is angled at an acute angle with respect to the second working plane in a direction of trim shaving;

attaching the secondary blade group to the razor head cartridge at the top surface to create an integrated one-piece razor head wherein the primary blade group is separate from the secondary blade group;

wherein the secondary blade group is attached so that the first and second working planes intersect at an included angle between about 0 degrees and 150 degrees.

2. The method of claim 1, wherein the secondary blade group is attached by bonding.

3. The method of claim 1, wherein the secondary blade group is attached by cementing.

4. The method of claim 1, wherein the razor head cartridge defines a handle axis and the secondary blade group is attached so that the first and second working planes intersect each other so as to define a line of intersection that is substantially transverse to the handle axis.

5. The method of claim 4, wherein the secondary blade group is attached so that the first and second working planes intersect at an included angle between about 75 degrees and 135 degrees.

6. The method of claim 4, wherein the secondary blade group is attached so that the first and second working planes are configured to allow conversion by a user of the razor cartridge from broad area shaving to trim shaving by rotating the handle 180 degrees about the handle axis.

7. The method of claim 1, wherein attaching the secondary blade group to the razor head cartridge includes attaching the secondary blade group to a top-back edge of the razor cartridge.

* * * * *